US010470634B2

(12) United States Patent
Ham et al.

(10) Patent No.: US 10,470,634 B2
(45) Date of Patent: Nov. 12, 2019

(54) VACUUM CLEANER AND HANDLE FOR A CLEANER

(71) Applicant: LG ELECTRONICS INC., Seoul (KR)

(72) Inventors: Dukho Ham, Seoul (KR); Seonghoon Han, Seoul (KR)

(73) Assignee: LG Electronics Inc., Seoul (KR)

( * ) Notice: Subject to any disclaimer, the term of this patent is extended or adjusted under 35 U.S.C. 154(b) by 173 days.

(21) Appl. No.: 15/643,889

(22) Filed: Jul. 7, 2017

(65) Prior Publication Data

US 2018/0008112 A1 Jan. 11, 2018

(30) Foreign Application Priority Data

Jul. 8, 2016 (KR) ..... 10-2016-0086958

(51) Int. Cl.

| | |
|---|---|
| ***A47L 9/28*** | (2006.01) |
| ***A47L 5/36*** | (2006.01) |
| ***A47L 9/10*** | (2006.01) |
| ***A47L 9/14*** | (2006.01) |
| ***A47L 9/24*** | (2006.01) |
| ***A47L 9/32*** | (2006.01) |

(52) U.S. Cl.

CPC ..... *A47L 9/2842* (2013.01); *A47L 5/362* (2013.01); *A47L 9/102* (2013.01); *A47L 9/1409* (2013.01); *A47L 9/244* (2013.01); *A47L 9/2805* (2013.01); *A47L 9/2857* (2013.01); *A47L 9/2894* (2013.01); *A47L 9/327* (2013.01)

(58) Field of Classification Search

CPC ..... A47L 9/2842; A47L 9/2894

USPC ..... 15/319, 339

See application file for complete search history.

(56) References Cited

U.S. PATENT DOCUMENTS

2008/0256741 A1* 10/2008 Garcia ..... A47L 9/00 15/319

FOREIGN PATENT DOCUMENTS

| | | |
|---|---|---|
| DE | 10 2011 053 836 | 3/2013 |
| EP | 2 682 034 | 1/2014 |
| JP | 2001-218716 | 8/2001 |
| KR | 10-1562136 | 10/2015 |

OTHER PUBLICATIONS

European Search Report dated Jan. 8, 2018 issued in Application No. 17180229.1.

Korean Office Action dated May 31, 2017 issued in Application No. 10-2016-0086958.

* cited by examiner

*Primary Examiner* — Andrew A Horton

(74) *Attorney, Agent, or Firm* — KED & Associates, LLP

(57) ABSTRACT

In order to accomplish a solution task of the present disclosure, a cleaner hand according to an embodiment of the present disclosure may include a pipe configured to transfer at least one of air, dust, and foreign matter to a drive unit that generates a suction force, a grip portion connected to the pipe, and formed to be gripped by a user, a sensor unit disposed in the grip portion to sense information related to whether or not the grip portion is gripped by the user, and a controller configured to control the drive unit based on the sensed information.

10 Claims, 6 Drawing Sheets

VACUUM CLEANER AND HANDLE FOR A CLEANER

CROSS-REFERENCE TO RELATED APPLICATIONS

The present disclosure relates to subject matter contained in priority Korean Application No. 10-2016-0086958, filed on Jul. 8, 2016, which is herein expressly incorporated by reference in its entirety.

BACKGROUND OF THE INVENTION

1. Field of the Invention

The present disclosure relates to a vacuum cleaner and a handle for a cleaner.

2. Description of the Related Art

In general, a vacuum cleaner is an apparatus for sucking dust and foreign matter existing on a surface to be cleaned using a suction motor provided inside a main body, and then filtering dust and foreign matter from an inside of the main body.

The foregoing vacuum cleaner may be classified into an up-right type vacuum cleaner in which a suction nozzle is connected to a main body to move together with the main body, and a canister type vacuum cleaner in which a suction nozzle is connected to a main body by an extension pipe, a handle, a hose, and the like.

In recent years, a battery may be installed in the foregoing vacuum cleaner to allow the cleaner itself to supply power, thereby performing a cleaning function even in a state that the cleaner is not connected to an external power source through a power line.

However, since a vacuum cleaner performing a cleaning function in a wireless manner should generate a suction force above an appropriate level or higher using limited energy, such a vacuum cleaner has a problem with a relatively short operation holding time.

In other words, considering a size of the vacuum cleaner, a space for installing the battery may be limited, and therefore, even when power is received from the battery, it is difficult to maintain the operation of the vacuum cleaner for a long period of time in which a suction force above an appropriate level should be generated.

Furthermore, in general, a vacuum cleaner is provided with a push button for switching an on/off state of the vacuum cleaner or a slide button for adjusting an output level of the vacuum cleaner on a handle portion. After such a button has received a user input, even when the vacuum cleaner is left without performing a cleaning operation such as actually sucking foreign matter, unnecessary power may be consumed since a compressor of the cleaner operates.

SUMMARY OF THE INVENTION

A technical task to be solved by the present disclosure is to provide a vacuum cleaner and a handle for a cleaner capable of reducing an unnecessary use time to increase the operation holding time of a canister type vacuum cleaner that receives power from a battery.

Furthermore, an object of the present disclosure is to provide a vacuum cleaner and a handle for a cleaner that activates a suction motor only at a user's desired point of time to actively reflect the user's intention.

In addition, an object of the present disclosure is to provide a vacuum cleaner and a handle for a cleaner that selectively performs a cleaning operation according to a simple user input, thereby minimizing a load applied to a user's finger and wrist.

In order to accomplish a solution task of the present disclosure, a cleaner hand according to an embodiment of the present disclosure may include a pipe configured to transfer at least one of air, dust, and foreign matter to a drive unit that generates a suction force, a grip portion connected to the pipe, and formed to be gripped by a user, a sensor unit disposed in the grip portion to sense information related to whether or not the grip portion is gripped by the user, and a controller configured to control the drive unit based on the sensed information.

According to an embodiment associated with the present disclosure, the sensor unit may include a temperature sensor configured to sense a temperature of a part of an outer surface of the grip portion.

According to an embodiment associated with the present disclosure, the controller may determine that the user grips the grip portion when the sensed temperature is above a reference temperature value.

According to an embodiment associated with the present disclosure, the controller may determine that the user grips the grip portion when the sensed temperature is within a reference temperature range.

According to an embodiment associated with the present disclosure, the sensor unit may include a pressure sensor configured to sense a pressure applied to a part of the outer surface of the grip portion.

According to an embodiment associated with the present disclosure, the controller may determine that the user grips the grip portion when the sensed pressure is above a reference pressure value.

According to an embodiment associated with the present disclosure, the controller may determine that the user grips the grip portion when the sensed pressure is within a reference pressure range.

According to an embodiment associated with the present disclosure, the controller may operate the drive unit when it is determined that the user grips the grip portion, and stop the drive unit if it is determined that the user does not grip the grip portion.

According to an embodiment associated with the present disclosure, the sensor unit may include a temperature sensor configured to sense a temperature of a part of an outer surface of the grip portion, and a pressure sensor configured to sense a pressure applied to a part of the outer surface of the grip portion.

According to an embodiment associated with the present disclosure, the controller may operate the drive unit when the sensed temperature is above a reference temperature value and the sensed pressure is above a reference pressure value.

According to an embodiment associated with the present disclosure, the controller may control the drive unit to adjust a magnitude of suction force generated from the drive unit according to a magnitude of the sensed pressure.

According to an embodiment associated with the present disclosure, the controller may control the pressure sensor to sense a pressure applied to a part of the outer surface of the grip portion at regular cycles when the sensed temperature is above a reference temperature value, compare a pressure sensed in a current cycle with a pressure sensed in a previous cycle, and control the drive unit based on the comparison result.

According to an embodiment associated with the present disclosure, the controller may increase an output of the drive unit when a pressure sensed in a current cycle is greater than a pressure sensed in a previous cycle, and decrease an output of the drive unit when a pressure sensed in a current cycle is less than a pressure sensed in a previous cycle.

In addition, a cleaner according to an embodiment of the present disclosure may include a cleaner body, a drive unit disposed in the cleaner body to generate a suction force, a pipe configured to transfer at least one of air, dust and foreign matter to the drive unit, a dust collector disposed in the cleaner body to filter dust in air transferred from the pipe, a grip portion connected to the pipe, and formed to be gripped by a user, a sensor unit disposed in the grip portion to sense information related to whether or not the grip portion is gripped by the user, and a controller configured to control the drive unit based on the sensed information.

According to an embodiment associated with the present disclosure, the sensor unit may include a temperature sensor configured to sense a temperature of a part of an outer surface of the grip portion.

According to an embodiment associated with the present disclosure, the controller may determine that the user grips the grip portion when the sensed temperature is above a reference temperature value, and operate the drive unit.

According to an embodiment associated with the present disclosure, the sensor unit may include a pressure sensor configured to sense a pressure applied to a part of the outer surface of the grip portion.

According to an embodiment associated with the present disclosure, the controller may determine that the user grips the grip portion when the sensed pressure is above a reference pressure value, and operate the drive unit.

According to an embodiment associated with the present disclosure, the sensor unit may include a temperature sensor configured to sense a temperature of a part of an outer surface of the grip portion, and a pressure sensor configured to sense a pressure applied to a part of the outer surface of the grip portion.

According to an embodiment associated with the present disclosure, the controller may operate the drive unit when the sensed temperature is above a reference temperature value and the sensed pressure is above a reference pressure value.

According to an embodiment associated with the present disclosure, a battery mat be provided within the cleaner body, and the battery may supply power to the cleaner when an external power source is not connected to the cleaner.

According to a vacuum cleaner and a handle for a cleaner in accordance with the present disclosure, a motor may be selectively activated only at the time when a user input is applied, thereby reducing an unnecessary use time of the vacuum cleaner, and increasing an operation holding time of the vacuum cleaner.

Furthermore, according to a vacuum cleaner and a handle for a cleaner in accordance with the present disclosure, the vacuum cleaner may be activated only at the time when a user input is applied, thereby obtaining an effect capable of accurately reflecting the user's intention.

In addition, according to the handle of the vacuum cleaner and the vacuum cleaner in accordance with the present disclosure, load on the user's finger, wrist or the like may be minimized while continuously requiring a user input during the operation of the cleaner, thereby enhancing the user's convenience.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, an embodiment disclosed in the present disclosure will be described in detail with reference to the accompanying drawings, and it should be noted that technological terms used herein are merely used to describe a specific embodiment, but not to limit the present invention. Also, unless particularly defined otherwise, technological terms used herein should be construed as a meaning that is generally understood by those having ordinary skill in the art to which the invention pertains, and should not be construed too broadly or too narrowly.

Figure 1:
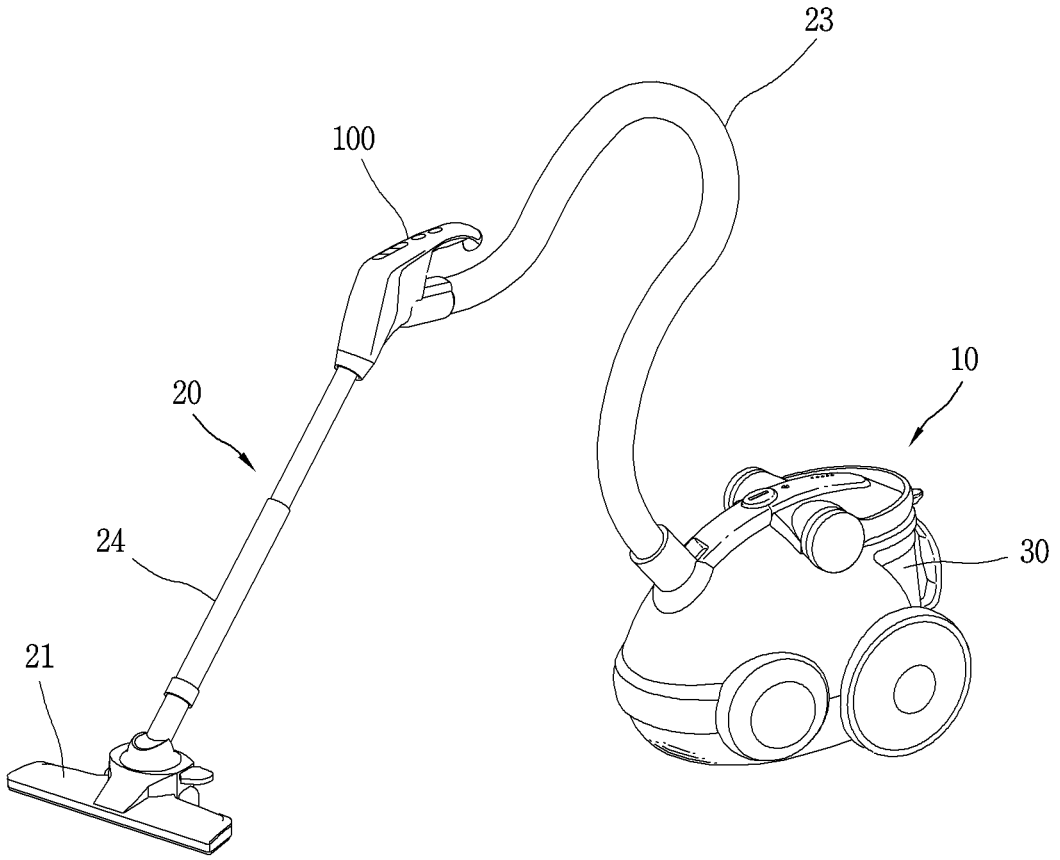
FIG. 1 is a perspective view illustrating a vacuum cleaner according to an embodiment of the present disclosure.

FIG. 1 is a perspective view illustrating a vacuum cleaner according to an embodiment of the present disclosure.

Referring to FIG. 1, a vacuum cleaner 1 according to an embodiment of the present disclosure may include a cleaner body 10 and a suction device 20 connected to the cleaner body 10.

The cleaner body 10 is provided with a drive unit for generating a suction force. The drive unit may include a suction motor and a suction fan rotated by the suction motor to generate a suction force.

In addition, the cleaner body 10 may include a rotatable wheel, and the wheel may move or rotate the cleaner body 10 forward, backward, left and right by rotation.

According to an example, the wheel may include main wheels and auxiliary wheels. The main wheels are respectively provided on both sides of the cleaner body 10. The auxiliary wheels are configured to support the cleaner body 10 together with the main wheels, and assist the movement of the cleaner body 10 by the main wheels.

The suction device 20 may include a suction unit 21 for sucking dust on a floor surface and a connection portion 23 for connecting the suction unit 21 to the cleaner body 10. According to an example, the suction portion 21 is configured to suck air in the vicinity of the suction portion 21. The air sucked by the suction unit 21 may contain foreign matter, dust, fine dust, ultrafine dust, and the like.

The connection portion 23 may be formed in the form of an extension pipe 24 connected to the suction unit 21, a handle 100 connected to the extension pipe 24, and a suction hose or pipe connecting the handle 100 to the main body 10.

The pipe may transfer at least one of air, dust, and foreign matter to the drive unit 150.

When the user moves or rotates the handle 100 back and forth or left and right while gripping the handle 100, a movement force of the handle 100 is transmitted to the suction unit 21, and thus the suction unit 21 performs cleaning while moving with respect to the floor surface.

Furthermore, the dust collector 30 is detachably coupled to the cleaner body 10. The dust collector 30 id configured to collect foreign matter, dust, and fine dust from the sucked air in a separate manner, and discharge the filtered air.

The dust collector 30 may include a dust separator for separating air and dust sucked in the suction device 20 from each other and a dust container for storing dust separated from the dust separator.

The dust container may be detachably mounted on the cleaner body 10. The dust separator may be fabricated as a separate article from the dust container, or may form one module with the dust container.

According to an embodiment, the vacuum cleaner may have a structure in which the connection unit is connected to the suction unit 21 formed in the cleaner body, and air sucked through a flow guide extended from the suction unit 21 to the dust collector 30 is introduced into the dust collector.

According to another embodiment, the vacuum cleaner connection unit 23 may be connected directly to the dust collector 30.

For reference, although a canister type vacuum cleaner 1 is illustrated in the drawing, the vacuum cleaner 1 according to the present disclosure may not be necessarily limited to the canister type, and may also be formed as an upright type.

Hereinafter, an embodiment of a cleaner handle 100 according to the present disclosure will be described with reference to FIG. 2.

The handle 100 may include an air passage (not shown) through which air and dust flow. In addition, the handle 100 may include a grip portion 101 for the user's grip. The handle 100 may further include a grip portion cover (not shown) which surrounds the grip portion 101 and is formed of a rubber material to improve the user's sense of grip.

The handle 100 may include an input unit 110 for controlling the operation of the vacuum cleaner 1. The input unit 110 may include a first button 111 for performing an on-off control of the vacuum cleaner 1 and a second button 112 for adjusting a magnitude of suction force of the vacuum cleaner 1.

Figure 2:
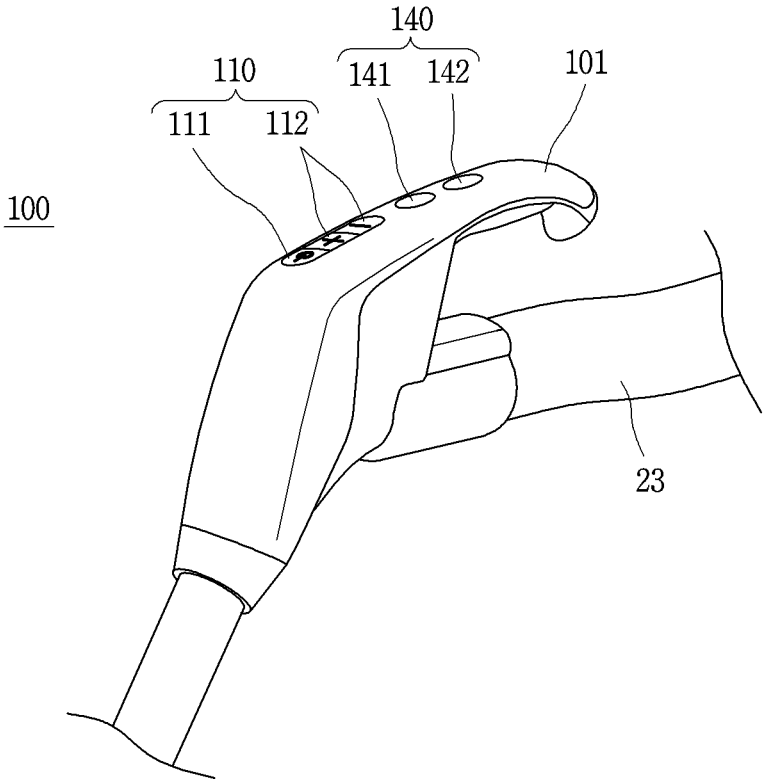
FIG. 2 is a perspective view illustrating a handle of a vacuum cleaner according to an embodiment of the present disclosure.

Furthermore, as illustrated in FIG. 2, the handle 100 may include a sensor unit 140 for sensing whether or not the user grips the handle.

Specifically, the sensor unit 140 may be disposed on an outer surface of the handle 100. In other words, the sensor unit 140 is formed to be mounted on an outer surface of the handle 100, and when the user grips the handle 100, the sensor unit 140 may brought into contact with the user's hand.

According to an embodiment, the sensor unit 140 may include a temperature sensor 141 and a pressure sensor 142. The temperature sensor 141 may sense a temperature of a part of an outer surface of the grip portion 101. The pressure sensor 142 may sense a pressure applied to a part of the outer surface of the grip portion 101.

Though not illustrated in FIG. 2, the input unit 110 for controlling the operation of the vacuum cleaner 1 may include a third button (not shown) for activating or deactivating the operation of the sensor unit 140. In other words, the sensor unit 140 may sense information related to whether or not the user grips the handle 100 or stop the operation based on a user input applied to the third button.

Figure 3:
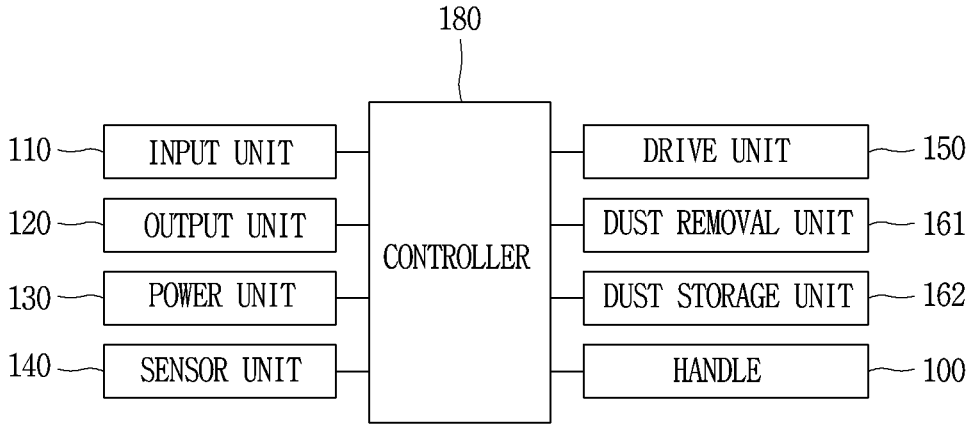
FIG. 3 is a block diagram illustrating the constituent elements of a vacuum cleaner according to an embodiment of the present disclosure.

Referring to FIG. 3, it is illustrated a block diagram showing the constituent elements of the vacuum cleaner 1 illustrated in FIG. 1.

The vacuum cleaner 1 according to the present disclosure may include an input unit 110, an output unit 120, a power unit 130, a sensor unit 140, a drive unit 150, a dust removal unit 161, a dust storage unit 162, and a handle 100.

The input unit 110 receives various control commands for the vacuum cleaner from the user. The input unit 110 may include one or more buttons, and for example, the input unit 110 may include an adjustment button for adjusting an output of the cleaner, a power button for turning on or off the power of the vacuum cleaner, and a mode setting button for setting an operation mode of the cleaner.

Furthermore, the input unit 110 may be installed on the cleaner handle 100. In addition, the input unit 110 may be installed with a hard key, a soft key, a touch pad, or the like. For an example, the input unit 110 may have the form of a touch screen together with the output unit 120.

Meanwhile, the output unit 120 may be installed on the cleaner body or the cleaner handle 100. Of course, the installation location and installation type thereof may vary. For example, the output unit 120 may display information related to an output level, a battery status, an operation mode, and the like on the screen.

Furthermore, the output unit 120 may be formed with at least one of a light emitting diode (LED), a liquid crystal display (LCD), a plasma display panel, and an organic light emitting diode (OLED).

The output unit 120 may further include an audio output device for audibly outputting information related to the operation of the cleaner carried out by the controller 180. For example, the output unit 120 may output a warning sound to the outside in accordance with a warning signal generated by the controller 180.

Here, the audio output device may be a device for outputting sound such as a beeper, a speaker, or the like, and the output unit 120 may output sound to the outside through the audio output device using audio data or message data having a predetermined pattern stored in the memory (not shown).

The power unit 130 may apply a DC voltage or AC voltage to the vacuum cleaner 1.

In other words, the power unit 130 may include a first power supply module (not shown) that supplies AC power supplied from an external power supply device or a commercial power source directly to at least one constituent element included in the cleaner. The first power supply module may include a rectifier circuit for converting an AC power source into a DC power source, a cord for transmitting AC power from a commercial power source, and a cord reel provided to wind the cord.

Furthermore, the power unit 130 may include a second power supply module (not shown) that supplies DC power supplied from a battery to at least one constituent element included in the cleaner. In other words, the second power supply module may include a battery and a power terminal, and may apply power to the constituent element of the vacuum cleaner 1 by using DC power generated from the battery.

Meanwhile, the power unit 130 may store power supplied from the external power supply unit in a battery to supply the stored power to at least one constituent element included in the cleaner. At this time, the battery may receive power from the external power supply unit through a power supply unit by a wired/wireless charging method. In other words, the battery may be directly connected to the external power supply unit through the power unit 130 included in the cleaner by a constituent element such as a power outlet or may be connected to the external power supply unit using at least one of a magnetic resonance coupling method, an electromagnetic induction method in a wireless manner, and a radiowave method to receive power.

The vacuum cleaner 1 is provided with a battery to receive power from the battery when it is not connected to an external power source.

The drive unit 150 may provide a suction force by a motor, and the motor may be a BLDC (Brushless DC) motor used in a typical vacuum cleaner, but the present disclosure may not be limited thereto.

The drive unit 150 may include a suction motor and a suction fan rotated by the suction motor to generate a suction force.

The dust removal unit 161 and the dust storage unit 162 may be installed inside or outside the main body 10 to facilitate coupling with and separation from the main body 10. For example, at least one of the dust removal unit 161 and the dust storage unit 162 may include a handle. The user may easily couple at least one of the dust removal unit 161 and the dust storage unit 162 to the main body 10 in a detachable manner by holding the handle.

The air introduced into the main body 10 may be discharged to an outside of the main body 10 through the dust removal unit 161. The dust removal unit 161 and the dust storage unit 162 may form such a air flow path.

Meanwhile, the dust storage unit 162 includes a case. In other words, it may include a container for storing dust. The case is communicated with the dust removal unit 161, and provided to store dust separated by the dust removal unit 161. In other words, the case forms an space or region separated from the dust removal unit 161 to store dust therein.

The dust storage unit 162 is preferably provided to be substantially horizontally installed with respect to the main body 10. In other words, it is preferable for the user to move the dust storage unit 162 in the horizontal direction to be coupled to or separated from the body. It is to allow the user to easily mount the dust storage portion 162 on the main body 10 or remove the dust storage portion 162 from the main body 10 even when only one hand is used.

Specifically, it is preferable that the dust storage unit 162 is communicated with the dust removal unit 161, but they are separated from each other spatially. In other words, it is preferable that the dust storage unit 162 is provided outside the dust removal unit 161, and the dust removal unit 161 is also provided outside the dust storage unit 162. To this end, the case of the dust storage unit 162 may include a receiving portion capable of substantially receiving the dust removal unit 161.

The dust removal unit 161 may be provided between the dust storage unit 162 and the main body 10 in a state that the dust storage unit 162 is coupled to the main body 10. In other words, the dust removal unit 161 is surrounded by the dust storage unit 162 and the main body 10. Accordingly, the dust removal unit 161 is preferably fixed to the main body 10 by the dust storage unit 162. The dust removal unit 161 is preferably provided between the dust storage unit 162 and the main body 10 not to be exposed to an outside of the cleaner 10.

The controller 180 controls an overall operation of the constituent elements included in the cleaner. The controller 180 may process signals, data, information, and the like inputted or outputted through the above-mentioned constituent elements or drive an application program stored in the memory (not shown) to provide or process appropriate information or functions for the user.

In addition, the controller 180 may control at least some of the constituent elements illustrated in FIG. 2 to drive an application program stored in the memory. Furthermore, in order to drive the application program, the controller 180 may operate at least two or more of the constituent elements included in the cleaner in combination with each other.

The controller 180 can determine whether or not the user grips the grip portion 101 of the handle 100 based on a temperature value sensed by the temperature sensor 141 or a pressure value sensed by the pressure sensor 142.

Specifically, the controller 180 may determine that the user grips the grip 101 when the temperature sensed by the temperature sensor 141 disposed on the handle 100 is above a reference temperature value. For example, the reference temperature value may be set to substantially correspond to a body temperature. In addition, the controller 180 may set the reference temperature differently according to a current date or time. Moreover, the controller 180 may store a temperature value sensed by the temperature sensor 141 at predetermined time intervals, and may set the reference temperature using the stored temperature value.

Furthermore, the controller 180 may determine that the user grips the grip portion 101 when a temperature sensed by the temperature sensor 101 is included in a reference temperature range. For example, when the sensed temperature exceeds a upper limit value of the reference temperature range, the controller 180 determines that heat applied to the temperature sensor 141 is due to an object other than the user to stop the operation of the drive unit 150.

Moreover, the controller 180 may determine that the user grips the grip portion 101 when a pressure sensed by the pressure sensor 142 disposed on the handle 100 is above a reference pressure value.

Specifically, the reference pressure value may be set by the user. The output unit 120 may output guide information for the user to set the reference pressure value at the time of initial operation of the cleaner 1, and the controller 180 may set the reference pressure value based on a pressure applied to the pressure sensor 142 subsequent to outputting the guide information.

For example, when the vacuum cleaner 1 is initially driven or when the vacuum cleaner 1 is operated in a mode for resetting the reference pressure value, the output unit 120 outputs voice information "Please hold the handle." The controller 180 may process information related to a pressure applied to the pressure sensor 142 at a plurality of time points during a preset time interval subsequent to outputting the voice information to set a reference pressure value. On the other hand, the guide information may not be necessarily limited to voice information, and may be output in various forms.

Furthermore, when the sensed pressure is within a reference pressure range, the controller 180 may determine that the user grips the grip portion 101. On the other hand, when the sensed pressure exceeds an upper limit value of the reference pressure range, the controller 180 determines that a pressure applied to the pressure sensor 142 is due to an object other than the user to stop the operation of the drive unit 150.

The controller 180 operates the drive unit 150 when it is determined that the user grips the grip portion 101, and stops the drive unit 150 when it is determined that the user does not grip the grip portion 101.

In other words, when it is determined that the user grips the grip portion 101 using at least one of the temperature sensor 141 and the pressure sensor 142 disposed on the handle 100, the controller 180 may control the drive unit 150 to generate a suction force of the cleaner 1.

According to an embodiment, the controller 180 may control the drive unit 150 to adjust a magnitude of suction force generated from the drive unit 150 according to a magnitude of the sensed pressure. In other words, the controller 180 may control the drive unit 150 to increase an output of the cleaner 1 as the user's force for gripping the handle 100 increases.

The foregoing controller 180 may be provided inside the main body 10 of the cleaner or may be provided inside the handle 100.

The input unit 110, the output unit 120, the sensor unit 140, and the controller 180 in the cleaner according to an embodiment may be provided at an inside or on an outer surface of the handle 100.

The input unit 110, the output unit 120, the power unit 130, the sensor unit 140, the drive unit 150, and the controller 180 in the cleaner according to another embodiment may be provided in the main body of the cleaner.

The input unit 110, the output unit 120, the sensor unit 140 and the controller 180 in the vacuum cleaner according to still another embodiment may be provided in the handle 100 and the main body of the vacuum cleaner, respectively.

Hereinafter, in FIGS. 4 through 6, embodiments related to a method of controlling the above-described vacuum cleaner 1 and the cleaner handle 100 will be described.

Figure 4:
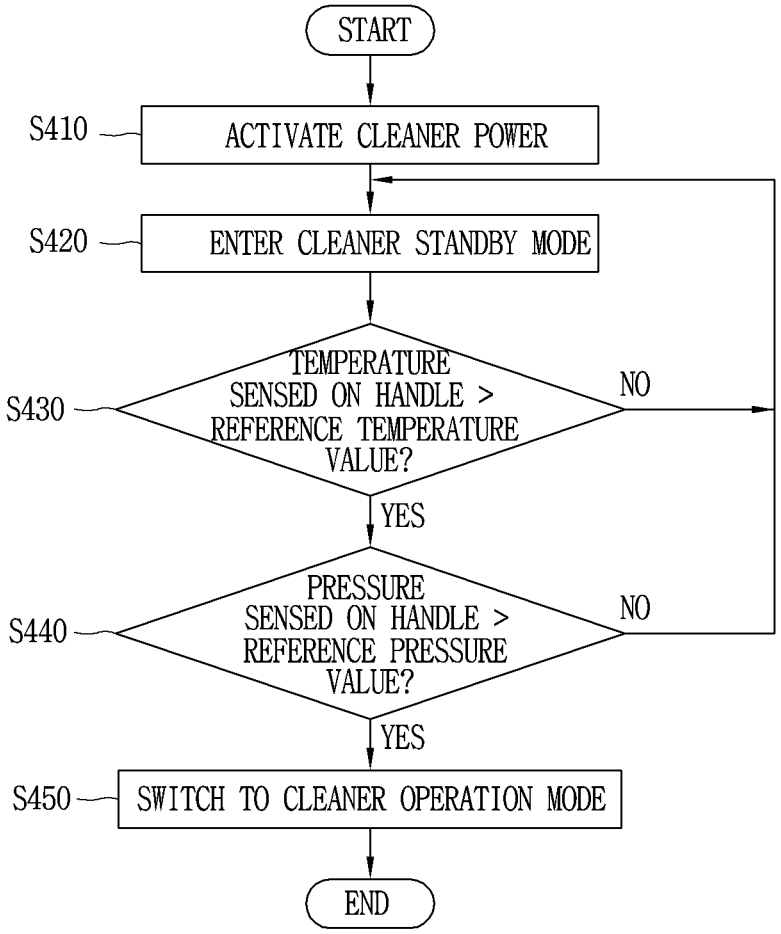
FIG. 4 is a flow chart illustrating a method of controlling a vacuum cleaner according to an embodiment of the present disclosure.

As illustrated in FIG. 4, when a user input is applied to the first button 111 on the input unit 110 provided on the handle 100, the power of the cleaner 1 may be activated (S410).

Subsequent to activating the power of the cleaner 1, the controller 180 of the cleaner 1 may control the drive unit 150 to generate a preset magnitude of suction force.

On the other hand, when an additional user input is not applied subsequent to activating the power of the cleaner 1, the cleaner 1 may enter a standby mode (S420). The vacuum cleaner 1 operating in a standby mode may consume a minimum amount of power to activate the sensor unit 140 and the controller 180 of the cleaner 1.

Next, the sensor unit 140 disposed on the handle 100 may sense a temperature of a part of an outer surface of the handle 100. In other words, the temperature sensor 141 included in the sensor unit 140 may sense a temperature of a part of an outer surface of the grip portion 101.

The controller 180 may determine whether or not a temperature sensed by the temperature sensor 141 is above a reference temperature value (S430). The reference temperature value may be set by the user. For an example, the reference temperature value may be set to 36° C.

The controller 180 can maintain the operation state of the cleaner 1 in a standby mode when the sensed temperature is below a reference temperature value.

Furthermore, the sensor unit 140 disposed on the handle 100 may sense a pressure applied to a part of an outer surface of the handle 100. In other words, the pressure sensor 142 included in the sensor unit 140 may sense a pressure applied to a part of the outer surface of the grip portion 101.

The controller 180 may determine whether or not a pressure sensed by the pressure sensor 142 is above a reference pressure value (S440). The reference pressure value may be set by the user.

The controller 180 may maintain the operating state of the cleaner 1 in a standby mode when a pressure sensed by the pressure sensor 142 is below a reference pressure value.

In other words, the controller 180 may maintain the operation state of the cleaner 1 in a standby mode when the sensed temperature is below a reference temperature or the sensed pressure is below a reference pressure.

On the contrary, when the sensed temperature is above a reference temperature and the sensed pressure is above a reference pressure, the controller 180 may switch the operation state of the cleaner 1 from a standby mode to an operation mode (S450).

According to the configuration of the present disclosure as described above, a motor of the drive unit 150 may be selectively activated only at the time when the user grips the handle 100, thereby reducing an unnecessary use time of the vacuum cleaner, and increasing an operation holding time of the vacuum cleaner with respect to the same capacity of battery.

Therefore, in a canister type wireless cleaner which requires sufficient output while being supplied with power from the battery, whether or not the user grips the handle may be accurately determined to limit a driving time point of the cleaner, thereby securing a minimum operation holding time.

Figure 5:
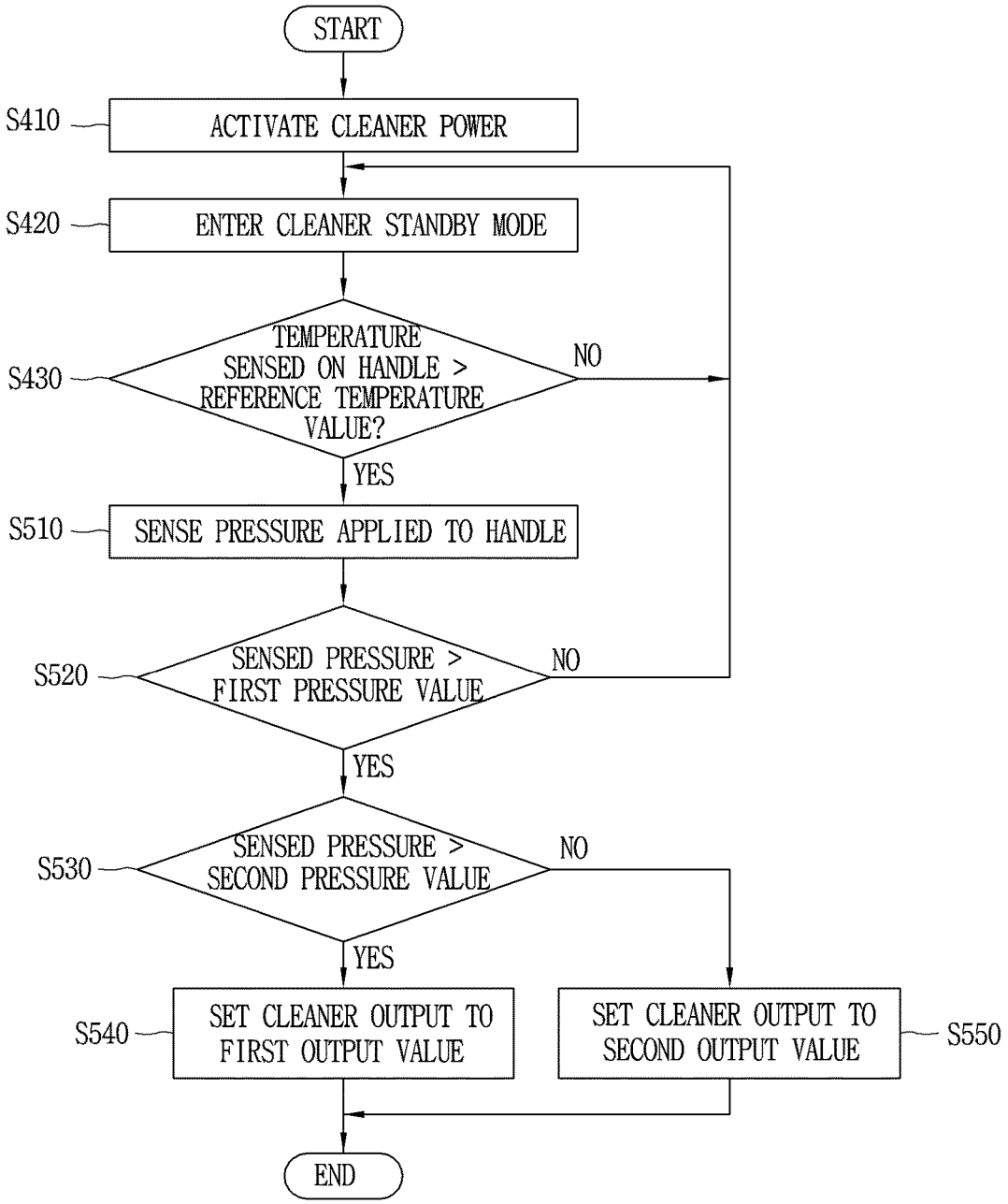
FIG. 5 is a flow chart illustrating a method of controlling a vacuum cleaner according to another embodiment of the present disclosure.

On the other hand as illustrated in FIG. 5, the controller 180 may determine whether or not a temperature sensed by the temperature sensor 141 is above a reference temperature value, and then when the sensed temperature is above a reference temperature value, the controller 180 may control the pressure sensor 142 of the sensor unit 140 to sense a pressure applied to the sensor unit 140 (S510).

The controller 180 may determine whether or not the sensed pressure is above a first pressure value (S520). The controller 180 may maintain the operation state of the cleaner 1 in a standby mode when a pressure applied to the handle 100 is less than the first pressure value.

Meanwhile, when the pressure applied to the handle 100 is greater than the first pressure value, the controller 180 may determine whether or not the applied pressure is above a second pressure value (S530). For example, the second pressure value may be set to be greater than the first pressure value.

The controller 180 may control the drive unit 150 to set an output of the cleaner 1 to a first output value when the applied pressure is greater than a second pressure value.

Furthermore, the controller 180 may control the drive unit 150 to set an output of the cleaner 1 to a second output value less than the first output value when the applied pressure is less than the second pressure value.

According to an embodiment, the controller 180 may store information related to an output level immediately before the end of the operation of the drive unit 150. When a pressure applied to the handle 100 is above a first pressure value and below a second pressure value, the controller 180 controls an output of the drive unit 150 in such a manner that an output of the drive unit 150 corresponds to an output level immediately before the end of the operation based on information related to a finally stored output level. Furthermore, when a pressure applied to the handle 100 is above a second pressure value, the controller 180 may set an output of the drive unit 150 to be greater than the output level immediately before the end of the operation.

Figure 6:
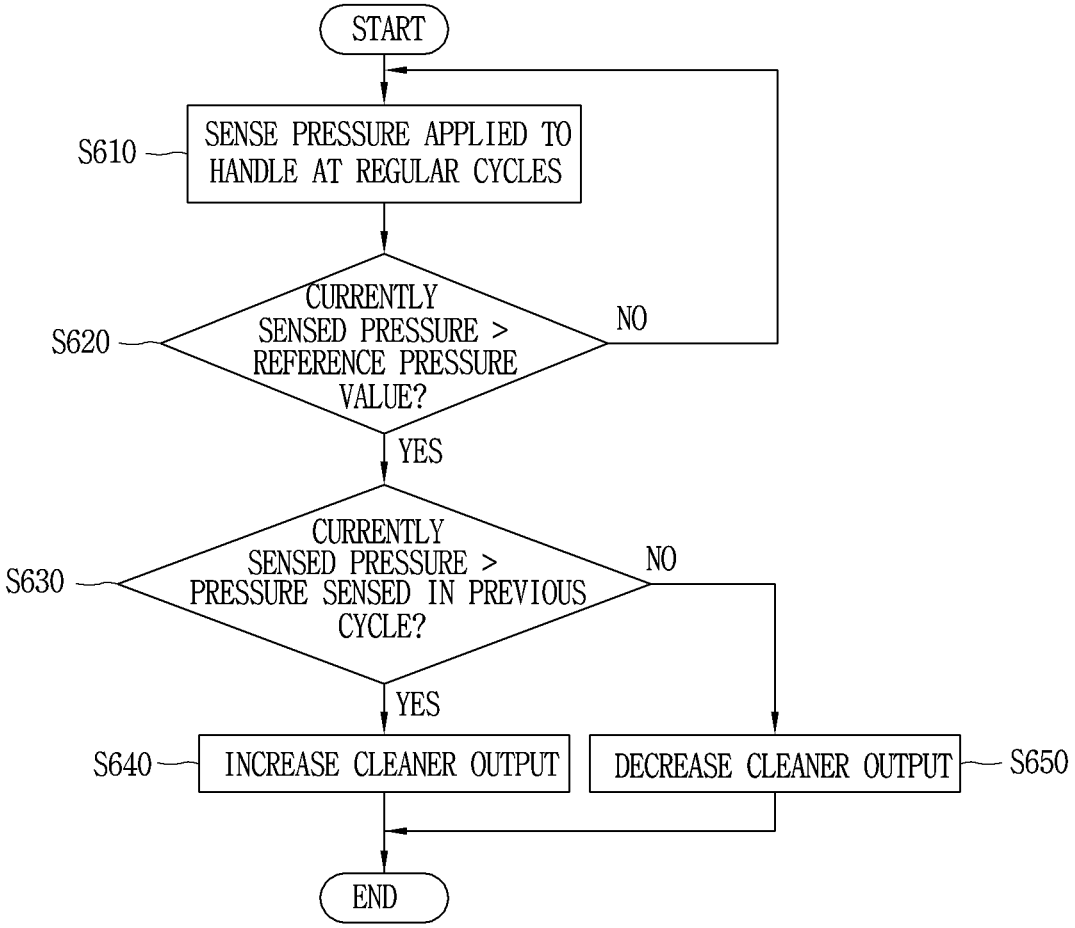
FIG. 6 is a flow chart illustrating a method of controlling a vacuum cleaner according to still another embodiment of the present disclosure.

Referring to FIG. 6, the controller 180 may control the pressure sensor 142 to sense a pressure applied to the handle 100 at regular cycles (S610). In addition, the controller 180 may store information related to a pressure value sensed by the pressure sensor 142 at regular cycles.

The controller 180 may determine whether or not a pressure sensed in a current cycle is above a reference pressure value (S620).

According to an embodiment, the controller 180 may stop the operation of the drive unit 150 when a pressure sensed in a current cycle is below a reference pressure value. In addition, the controller 180 may operate the drive unit 150 when a pressure sensed in a current cycle is above the reference pressure value.

The controller 180 may determine whether or not a pressure sensed in a current cycle is above a pressure sensed at a previous cycle (S630).

The controller 180 may control the drive unit 150 to increase an output of the cleaner 1 when a pressure sensed in a current cycle is above a pressure sensed in a previous cycle (S640).

The controller 180 may control the drive unit 150 to reduce an output of the cleaner 1 when a pressure sensed in a current period is below a pressure sensed in a previous cycle (S650).

Meanwhile, the controller 180 may maintain an output of the cleaner 1 when a difference between a pressure sensed in a current cycle and a pressure sensed in a previous cycle is below a preset pressure difference.

According to a vacuum cleaner and a handle for a cleaner in accordance with the present disclosure, a motor may be selectively activated only at the time when a user input is applied, thereby reducing an unnecessary use time of the vacuum cleaner, and increasing an operation holding time of the vacuum cleaner.

Furthermore, according to a vacuum cleaner and a handle for a cleaner in accordance with the present disclosure, the vacuum cleaner may be activated only at the time when a user input is applied, thereby obtaining an effect capable of accurately reflecting the user's intention.

In addition, according to the handle of the vacuum cleaner and the vacuum cleaner in accordance with the present disclosure, load on the user's finger, wrist or the like may be minimized while continuously requiring a user input during the operation of the cleaner, thereby enhancing the user's convenience.

It is obvious to those skilled in the art that the present disclosure can be embodied in other specific forms without departing from the concept and essential characteristics thereof. Accordingly, the detailed description thereof should not be construed as restrictive in all aspects but considered as illustrative. The scope of the invention should be determined by reasonable interpretation of the appended claims and all changes that come within the equivalent scope of the invention are included in the scope of the invention.

What is claimed is:

1. A cleaner handle, comprising:

a pipe configured to transfer at least one of air, dust, and foreign matter to a drive unit that generates a suction force;

a grip portion connected to the pipe, and formed to be gripped by a user;

a sensor unit disposed in the grip portion to sense information related to whether or not the grip portion is gripped by the user; and a controller configured to control the drive unit based on the sensed information, wherein the sensor unit comprises:

a temperature sensor configured to sense a temperature of a part of an outer surface of the grip portion, and a pressure sensor configured to sense a pressure applied to a part of the outer surface of the grip portion, and the controller operates the drive unit when the sensed temperature is above a reference temperature value and the sensed pressure is above a reference pressure value, controls the pressure sensor to sense the pressure applied to the part of the outer surface of the grip portion at regular cycles when the sensed temperature is above the reference temperature value, compares a pressure sensed in a current cycle with a pressure sensed in a previous cycle, and controls the drive unit based on the comparison result.

2. The cleaner handle of claim 1, wherein the controller determines that the user grips the grip portion when the sensed temperature is above the reference temperature value.

3. The cleaner handle of claim 1, wherein the controller determines that the user grips the grip portion when the sensed temperature is within a reference temperature range.

4. The cleaner handle of claim 1, wherein the controller determines that the user grips the grip portion when the sensed pressure is above the reference pressure value.

5. The cleaner handle of claim 4, wherein the controller determines that the user grips the grip portion when the sensed pressure is within a reference pressure range.

6. The cleaner handle of claim 1, wherein the controller operates the drive unit when it is determined that the user grips the grip portion, and stops the drive unit if it is determined that the user does not grip the grip portion.

7. The cleaner handle of claim 1, wherein the controller increases an output of the drive unit when the pressure sensed in the current cycle is greater than the pressure sensed in the previous cycle, and decreases an output of the drive unit when the pressure sensed in the current cycle is less than the pressure sensed in the previous cycle.

8. A cleaner, comprising:

a cleaner body;

a drive unit disposed in the cleaner body to generate a suction force;

a pipe configured to transfer at least one of air, dust and foreign matter to the drive unit;

a dust collector disposed in the cleaner body to filter dust in air transferred from the pipe;

a grip portion connected to the pipe, and formed to be gripped by a user;

a sensor unit disposed in the grip portion to sense information related to whether or not the grip portion is gripped by the user; and a controller configured to control the drive unit based on the sensed information, wherein the sensor unit comprises:

a temperature sensor configured to sense a temperature of a part of an outer surface of the grip portion, and a pressure sensor configured to sense a pressure applied to a part of the outer surface of the grip portion, and the controller operates the drive unit when the sensed temperature is above a reference temperature value and the sensed pressure is above a reference pressure value, controls the pressure sensor to sense the pressure applied to the part of the outer surface of the grip portion at regular cycles when the sensed temperature is above the reference temperature value, compares a pressure sensed in a current cycle with a pressure sensed in a previous cycle, and controls the drive unit based on the comparison result.

9. The cleaner of claim 8, wherein the controller determines that the user grips the grip portion when the sensed temperature is above the reference temperature value, and operates the drive unit.

10. The cleaner of claim 8, wherein the controller determines that the user grips the grip portion when the sensed pressure is above the reference pressure value, and operates the drive unit.

* * * * *